US007854291B2

(12) United States Patent
Akahane et al.

(10) Patent No.: US 7,854,291 B2
(45) Date of Patent: Dec. 21, 2010

(54) WORK MACHINE

(75) Inventors: Eiji Akahane, Tokyo (JP); Nobumi Toyoura, Tokyo (JP); Shigeru Kojima, Tokyo (JP); Masayuki Takano, Hyogo (JP)

(73) Assignee: Caterpillar S.A.R.L., Geneva (CH)

( * ) Notice: Subject to any disclaimer, the term of this patent is extended or adjusted under 35 U.S.C. 154(b) by 423 days.

(21) Appl. No.: 12/095,027

(22) PCT Filed: Sep. 20, 2006

(86) PCT No.: PCT/JP2006/318580

§ 371 (c)(1),
(2), (4) Date: May 27, 2008

(87) PCT Pub. No.: WO2007/063634

PCT Pub. Date: Jun. 7, 2007

(65) Prior Publication Data

US 2010/0000367 A1 Jan. 7, 2010

(30) Foreign Application Priority Data

Dec. 2, 2005 (JP) ..... 2005-349063

(51) Int. Cl.
*G05G 1/30* (2008.04)

(52) U.S. Cl. ..... 180/333; 74/471 R; 74/514

(58) Field of Classification Search ..... 180/333, 180/321, 323, 324, 315; 74/471 R, 481, 74/512, 514

See application file for complete search history.

(56) References Cited

U.S. PATENT DOCUMENTS

| | | | | |
|---|---|---|---|---|
| 5,422,521 | A * | 6/1995 | Neer et al. | 307/119 |
| 6,854,554 | B2 * | 2/2005 | Brandt et al. | 180/333 |
| 7,204,338 | B2 * | 4/2007 | Katae et al. | 180/315 |
| 7,516,811 | B2 * | 4/2009 | Kolpasky et al. | 180/333 |
| 7,621,366 | B2 * | 11/2009 | Sewell et al. | 180/324 |
| 7,729,835 | B2 * | 6/2010 | Morris et al. | 701/50 |
| 2002/0074181 | A1 * | 6/2002 | Brandt et al. | 180/315 |
| 2003/0037985 | A1 * | 2/2003 | Jeppe et al. | 180/333 |
| 2005/0023066 | A1 * | 2/2005 | McGoldrick | 180/315 |
| 2006/0137931 | A1 * | 6/2006 | Berg et al. | 180/333 |

(Continued)

FOREIGN PATENT DOCUMENTS

JP 06-136778 A 5/1994

(Continued)

*Primary Examiner*—Paul N Dickson
*Assistant Examiner*—Drew Brown
(74) *Attorney, Agent, or Firm*—McDermott Will & Emery LLP

(57) ABSTRACT

In a work machine equipped with a switchover means enabling selective operation of traveling devices and a work device by means of common operating levers, switchover can easily be performed and also easily recognized. In a work machine having traveling devices and a work device, operating levers that are capable of operating the traveling devices and the work device are respectively disposed at the sides of an operating seat. A foot switch connected to a controller is disposed in the proximity of and operable with a foot of an operator seated at the operating seat. While the foot switch is being operated with the foot, the traveling devices are operated by the operating levers through the controller. While the foot switch is not being operated, the work device is operated by means of the operating levers through the controller.

3 Claims, 5 Drawing Sheets

U.S. PATENT DOCUMENTS

2006/0185925 A1* 8/2006 Kolpasky et al. ..... 180/333
2009/0048743 A1* 2/2009 Akahane et al. ..... 701/50

FOREIGN PATENT DOCUMENTS

JP 07-032901 A 2/1995
JP 07-119710 A 5/1995
JP 09-165788 A 6/1997
JP 2000-027238 A 1/2000
JP 2002-323931 A 11/2002
JP 2003-049455 A 2/2003
JP 2004-100397 A 4/2004

* cited by examiner

WORK MACHINE

CROSS REFERENCE TO RELATED APPLICATIONS

This is a U.S. national phase application under 35 U.S.C. §371 of International Patent Application No. PCT/JP2006/318580, filed Sep. 20, 2006 and claims the benefit of Japanese Application No. 2005-349063, filed Dec. 2, 2005, both of them are incorporated by reference herein. The International Application was published in Japanese on Jun. 7, 2007 as WO 2007/063634 under PCT Article 21(2).

TECHNICAL FIELD

The present invention relates to a work machine provided with a traveling devices and a work device.

BACKGROUND

As shown in FIG. 5, a hydraulic shovel 1 is a work machine provided with a lower structure, an upper swing body 3, a cab 4, and a work device 5. The lower structure has right and left traveling devices 2 adapted to be respectively driven by right and left travel motors 2*m*. The upper swing body 3 is adapted to be rotated on the lower structure by a swing motor 3*m*. The cab 4 and the work device 5 are mounted on the upper swing body 3. The work device 5 comprises a boom 6 adapted to be vertically pivoted by boom cylinders 6*c*, a stick 7 to be pivoted by a stick cylinder 7*c*, and a bucket 8 to be pivoted by a bucket cylinder 8*c*, wherein the base end of the boom 6 is supported at the upper swing body 3 by a shaft; the stick 7 is supported at the distal end of the boom 6 by a shaft; and the bucket 8 is supported at the distal end of the stick 7 by a shaft.

In the cab 4 of a typical hydraulic shovel structured as above, traveling pedals and travel levers for operating the right and left traveling devices 2 of the lower structure are disposed on the floor in front of the operating seat.

Operating the traveling pedals with the feet is sufficient for broad travel operation but inadequate to perform fine operation. Therefore, when performing fine operation with a travel lever, it is necessary for the operator to remove a hand from one of the operating levers (work device/swing operating levers) that are disposed at the right and left sides of the operating seat respectively to rotate the upper swing body 3 or the work device 5, and reach for the travel lever, which is disposed in front of the operator.

Furthermore, when separately operating the right and left travel levers, it is necessary to reach forward with both hands.

Therefore, a structure that includes travel levers disposed in front of the operating seat may cause the travel levers to obstruct the operator from entering or exiting the cab 4, or it compels the operator to change his position or shift his hand when operating a travel lever.

Some examples of conventionally known structures to solve the above problems include providing a travel control lever in the proximity of a work device/swing operating lever disposed at a side of the operating seat (e. g. See Japanese Laid-open Patent Publication No. 6-136778; (page 4 and FIG. 9); Japanese Laid-open Patent Publication No. 7-32901 (page 3 and FIG. 2); Japanese Laid-open Patent Publication No. 2002-323931 (page 4 and FIG. 1) and Japanese Laid-open Patent Publication No. 2004-100397 (pages 7 and 15-17, and FIGS. 1 and 11)).

These structures facilitate entering and exiting of the operator but do not solve the problem of switching the hand from the operating lever to perform traveling operation.

Moreover, sufficient space for installation of the travel lever has to be allotted at a side of the operating seat.

Other structures are known, in which a switchover device is provided to enable one of the two work device/swing operating levers to serve as a travel lever (e. g. See Japanese Laid-open Patent Publication No. 7-119710 (pages 2-3 and FIG. 1) and Japanese Laid-open Patent Publication No. 2000-27238 (pages 4-7 and FIG. 1)).

Furthermore, yet other structures are known, in which the right and left work device/swing operating levers are enabled to respectively and independently operate the right and left traveling devices (e. g. See Japanese Laid-open Patent Publication No. 2004-100397 (pages 7 and 15-17, and FIGS. 1 and 11)) and Patent Document 7: Japanese Laid-open Patent Publication No. H09-165788 (pages 3-4 and FIGS. 3-4).

In any one of the structures that are offered in the Patent Documents mentioned above and include a switchover device provided separately from the operating levers, the operator has to remove his hand from an operating lever in order to operate the switchover device, which is nearly as inconvenient as switching one's hand from one lever to another. Even if the switchover device is attached to an operating lever, it is difficult for the operator to ascertain whether switchover has taken place, and the operator has to think about which device the operating lever has engaged for operation at the moment.

DESCRIPTION OF THE INVENTION

As described above, a work machine having travel levers disposed on the floor in front of the operating seat not only makes it difficult for the operator to enter or exist the machine but also compels the operator to change his position or shift his hand when operating a travel lever. Even if a switchover device is provided separately from the operating levers, the operator has to remove his hand from an operating lever in order to operate the switchover device.

In cases where an operating lever is provided with a switchover device so that switching the switchover device enables travel operation through a work device/swing operating lever, it is difficult for the operator to ascertain whether switchover has taken place.

This may result in a situation such as the operator operating the operating lever by mistake, causing the work device to move when travel operation is intended, or erroneously causing travel operation while intending to operate the work device.

In order to solve the above problems, an object of the invention is to provide a work machine equipped with a switchover means enabling selective operation of a traveling device and a work device by means of a common operating lever, wherein switchover can easily be performed and also easily recognized.

SUMMARY OF THE INVENTION

The present invention according to Claim 1 relates to a work machine having a traveling device and a work device, wherein the work machine includes an operating seat; an operating lever disposed at a side of the operating seat and able to operate the traveling device and the work device; a foot-operated switchover means disposed in the proximity of and operable with a foot of an operator seated at the operating seat; and a controller adapted to control the traveling device through the operating lever while the foot-operated switchover means is being operated with the foot, and control the work device through the operating lever while the foot-operated switchover means is not being operated.

The present invention according to Claim 2 relates also to a traveling alarm adapted to be activated when the foot-operated switchover means is operated with the foot.

The present invention according to Claim 3 relates also to a traveling pedal adapted to be operated with a foot of the operator seated at the operating seat; and a warning alarm adapted to be activated when the traveling pedal and the foot-operated switchover means are simultaneously operated with the foot.

According to the present invention, the foot-operated switchover means, which serves to enable the common operating lever to operate the traveling device and the work device, is disposed in the proximity of and operable with a foot of an operator seated at the operating seat. Therefore, switchover can easily be performed and it can also be easily recognized that switchover has taken place. In other words, by operating the foot-operated switchover means with his foot, the operator is able to perform travel operation consciously with the operating lever. By simply removing the foot from the foot-operated switchover means, the operator is able to return the machine to the normal operation mode without having to release his hand from the operating lever.

According to the present invention, whenever the foot-operated switchover means is stepped on, the foot-operated switchover means activates the traveling alarm, making the operator fully aware that travel operation is being performed with the operating lever. Furthermore, the traveling alarm is sounded prior to travel action taking place by the operating lever, allowing ample time to alert people in the vicinity.

According to the present invention, should the traveling pedal and the foot-operated switchover means be simultaneously stepped on, the warning alarm is activated to prevent a mix-up that would otherwise be caused by simultaneous commands for travel operation from the traveling pedal and the operating lever.

DETAILED DESCRIPTION OF THE INVENTION

Figure 1:
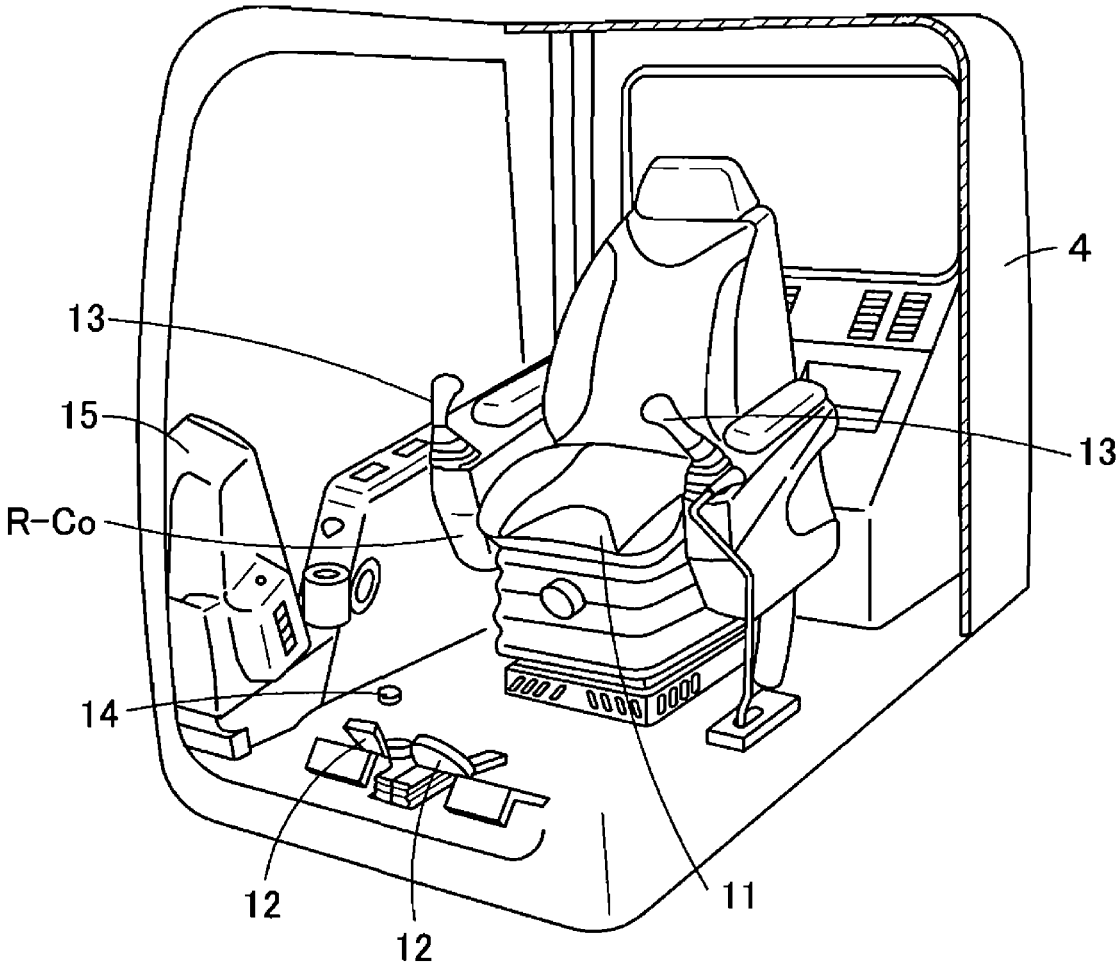
FIG. 1 is a perspective view showing a configuration of the interior of the cab of a work machine according to an embodiment of the present invention.
Figure 2:
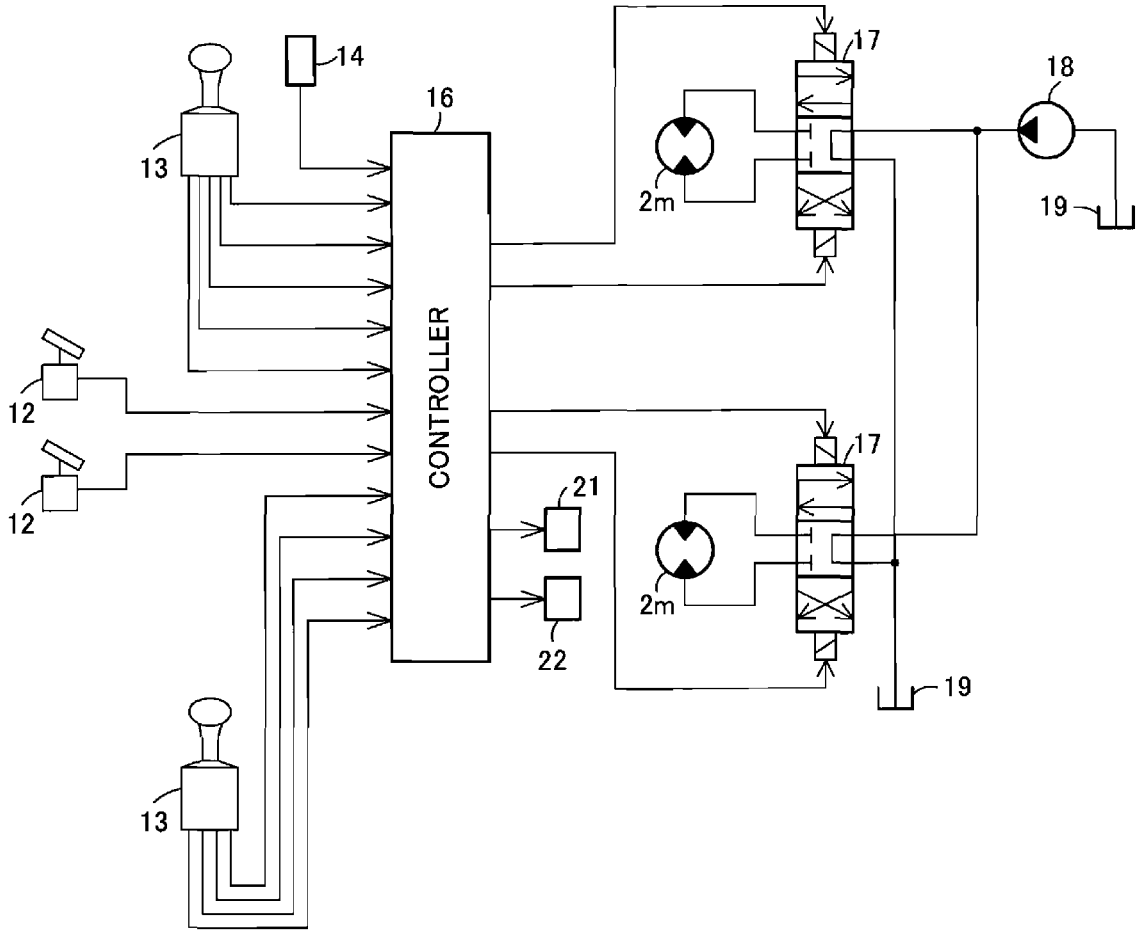
FIG. 2 is a block diagram of a travel control system of the work machine.
Figure 3:
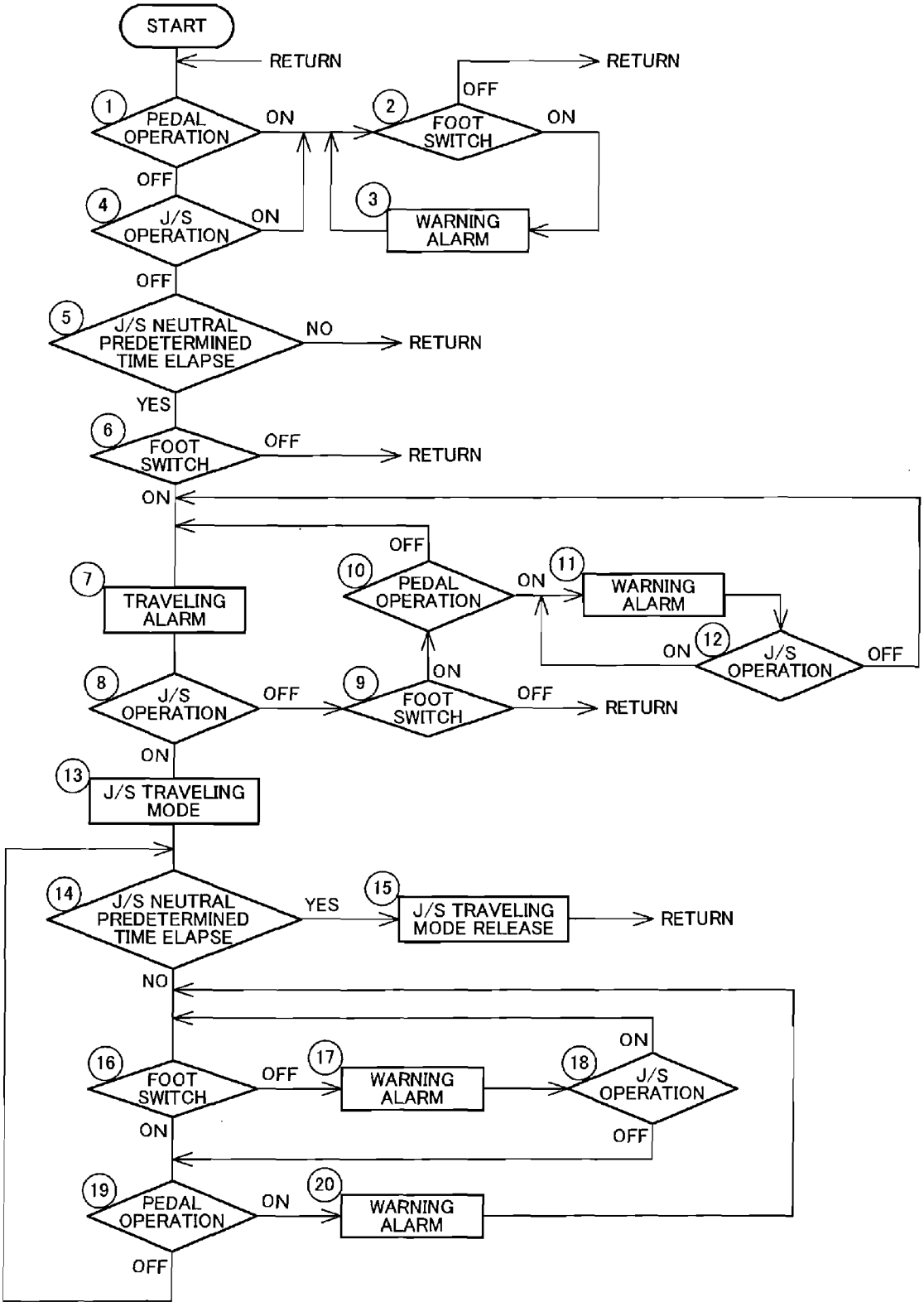
FIG. 3 is a flow chart showing an example of a control process of the travel control system.
Figure 4:
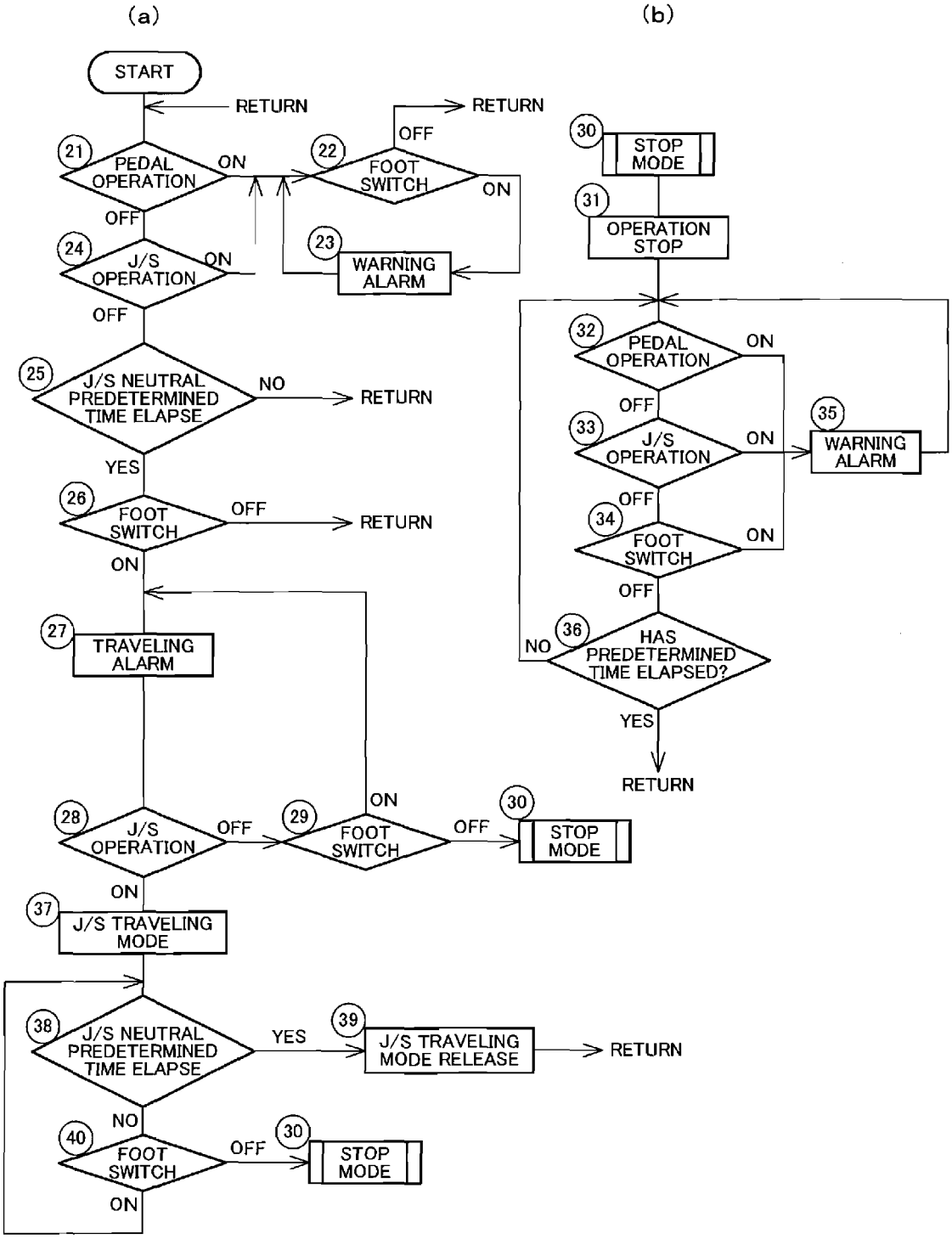
FIG. 4 is a flow chart showing another example of a control process of the travel control system.
Figure 5:
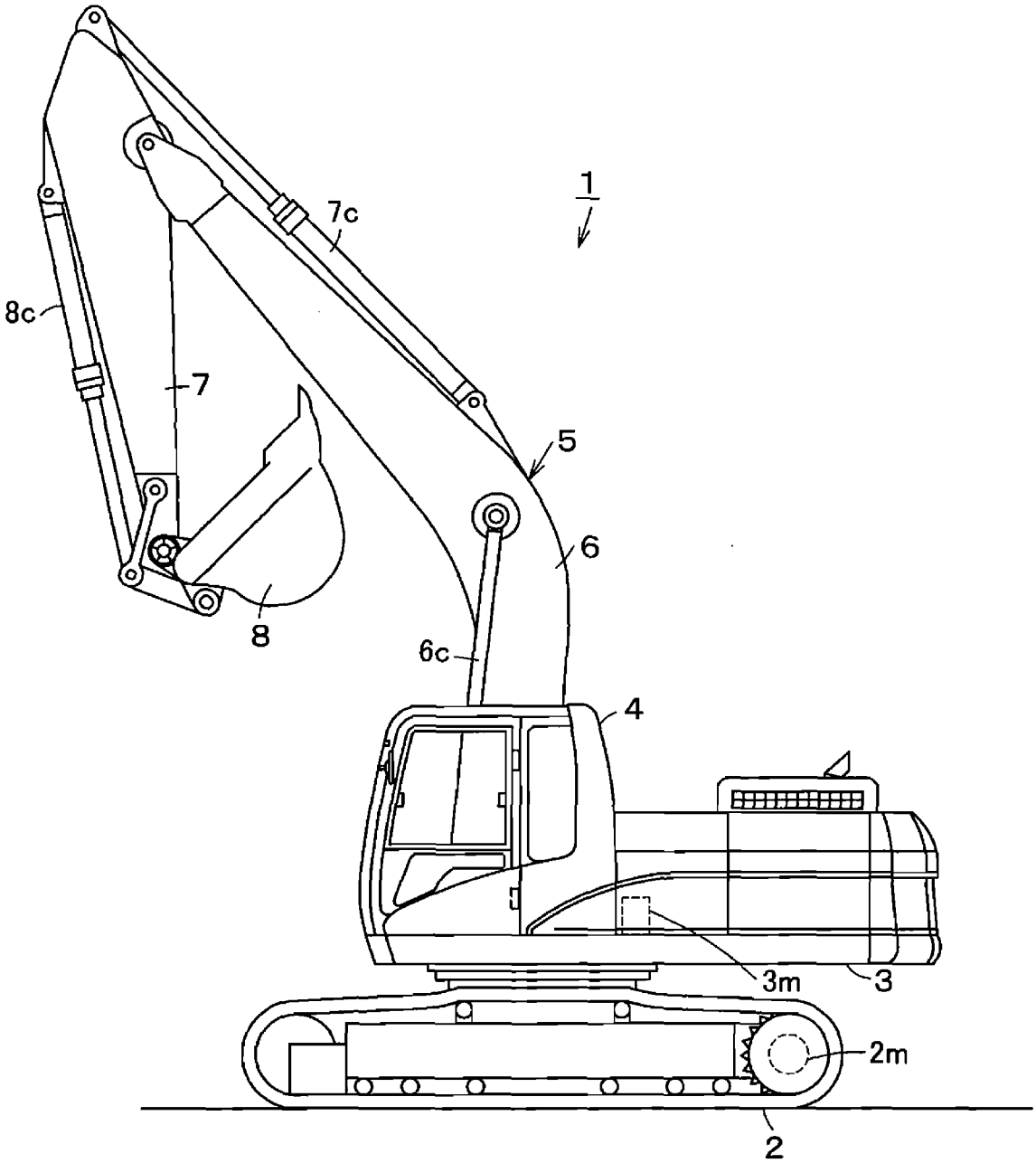
FIG. 5 is a side view of the work machine.

The present invention is explained in detail hereunder, referring to an embodiment thereof and an example of a control process shown in FIGS. 1 through 3, another example of the control process shown in FIG. 4, and a work machine shown in FIG. 5. However, as the work machine shown in FIG. 5 has already been explained, a detailed explanation is not given hereunder.

As shown in FIG. 5, a hydraulic shovel 1 is a work machine having traveling devices 2 and a work device 5. As shown in FIG. 1, the hydraulic shovel 1 has a cab 4, in which two traveling pedals 12 for the right and left traveling devices 2 are disposed on the floor in front of an operating seat 11, and two operating levers joystick levers) 13 that are capable of operating the traveling device 2 and the work device 5 are disposed at the right and left sides of the operating seat 11 respectively. The travel levers that are integrally included with the traveling pedals 12 in a conventional configuration are not provided.

A foot switch 14 serving as a foot-operated switchover means is disposed in the proximity of a foot of an operator seated at the operating seat 11, in other words on the floor in front of the right console R-Co shown in FIG. 1, so that the operator can operate the foot switch 14 with his foot. A monitor 15 equipped with an input device is provided diagonally in front of the foot switch 14.

As shown in FIG. 2, the traveling pedals 12, the operating levers 13, and the foot switch 14 are connected to the input side of a controller 16. Travel control valves 17 are provided to respectively control the right and left travel motors 2*m*. Each travel control valve 17 has an electromagnetic operation unit connected to the output side of the controller 16. A hydraulic pump 18 for feeding hydraulic oil through the hydraulic line and a tank 19 for recovering return oil are connected to oil supply ports and oil discharge ports of the travel control valves 17.

The controller 16 serves to control the traveling devices 2 through the operating levers 13 while the operator is operating the foot switch 14 with his foot, and control the work device 5 through the operating levers 13 while the foot switch 14 is not being operated. When controlling the traveling devices 2 through the operating levers 13, the controller 16 performs control so that operating either operating lever 13 forward or rearward enables the corresponding travel motor 2*m* to function for forward or reverse travel.

A traveling alarm 21 and a warning alarm 22 are connected to the controller 16. The traveling alarm 21 is adapted to be activated when the operator operates the foot switch 14 with a foot, and the warning alarm 22 is adapted to be activated should an operation error occur. The traveling alarm 21 and the warning alarm 22 are provided as a part of the monitor 15 or other appropriate equipment.

Next, an example of a control process of the travel control system by the controller 16 is explained hereunder, based on the flow chart shown in FIG. 3. In the drawing, numerals enclosed with circles represent step numbers.

(Step 1)

Whether or not a traveling pedal 12 has been operated is determined.

(Step 2)

If operation of at least one traveling pedal 12 is ascertained in Step 1, whether or not the foot switch 14 has been stepped on is determined. If the foot switch 14 is not depressed, the process returns to Step 1.

(Step 3)

If operation of at least one traveling pedal 12 is ascertained in Step 1, and operation of the foot switch 14 is ascertained in Step 2, the warning alarm 22 is activated.

(Step 4)

If neither traveling pedal 12 is ascertained in Step 1 to have been operated, whether or not an operating lever 13 has been operated is determined. If operation of at least one operating lever 13 is ascertained, the process returns to Step 2.

(Step 5)

If neither operating lever 13 is ascertained in Step 4 to have been operated, whether or not the operating levers 13 have been at the neutral position, at which the operating levers 13 are not being operated, for a predetermined period of time is determined. Until the predetermined period of time elapses, the process keeps returning to Step 1.

(Step 6)

If it is ascertained in Step 5 that the operating levers 13 have been at the neutral position for the predetermined period of time, whether or not the foot switch 14 has been stepped on is determined. If the foot switch 14 is not depressed, the process returns to Step 1.

(Step 7)

If operation of the foot switch 14 is ascertained in Step 6, the traveling alarm 21 is activated. The traveling alarm 21 provides an alarm not as a warning that an erroneous action has been taken but only to provide indication that the foot switch 14 is stepped on.

(Step 8)

Whether or not an operating lever 13 has been operated is determined.

(Step 9)

If neither operating lever 13 is ascertained in Step 8 to have been operated, whether or not the foot switch 14 has been stepped on is determined. If the foot switch 14 is not depressed, the process returns to Step 1.

(Step 10)

If operation of the foot switch 14 is ascertained in Step 9, whether or not a traveling pedal 12 has been stepped on is determined. If neither traveling pedal 12 has been stepped on, the process returns to Step 7.

(Step 11)

If operation of the foot switch 14 is ascertained in Step 9, and operation of at least one traveling pedal 12 is ascertained in Step 10, the warning alarm 22 is activated.

(Step 12)

Whether or not an operating lever 13 has been operated is determined. If operation of at least one operating lever 13 is ascertained, the warning alarm 22 continues to sound. If neither operating lever 13 is ascertained to have been operated, the process returns to Step 7.

(Step 13)

If operation of at least one operating lever 13 is ascertained in Step 8, a joystick lever traveling mode is initiated, enabling the operating levers 13 to control the travel control valves 17 so as to operate the travel motors 2*m*.

(Step 14)

Whether or not the operating levers 13 have been at the neutral position, at which the operating levers 13 are not being operated, for a predetermined period of time is determined.

(Step 15)

If it is ascertained that the operating levers 13 have been at the neutral position for the predetermined period of time, the joystick lever traveling mode is deactivated, and the process returns to Step 1.

(Step 16)

If it is ascertained in Step 14 that the operating levers 13 have been at the neutral position, but the predetermined period of time has not yet elapsed, determination of whether or not the foot switch 14 has been stepped on continues until the predetermined period of time elapses.

(Step 17)

If it is ascertained in Step 16 that the foot switch 14 is not depressed, the warning alarm 22 is activated.

(Step 18)

Whether or not an operating lever 13 has been operated is determined. If operation of at least one operating lever 13 is ascertained, the process returns to Step 16. If neither operating lever 13 is ascertained to have been operated, the process proceeds to the next step, i.e. Step 19.

(Step 19)

Whether or not a traveling pedal 12 has been operated is determined. If neither traveling pedal 12 has been operated, the process keeps returning to Step 14.

(Step 20)

If operation of at least one traveling pedal 12 is ascertained in Step 19, the warning alarm 22 is activated, and the process returns to Step 16.

Next, another example of a control process of the travel control system by the controller 16 is explained hereunder, based on the flow chart shown in FIG. 4. In the drawing, numerals enclosed with circles represent step numbers.

(Step 21)

Whether or not a traveling pedal 12 has been operated is determined.

(Step 22)

If operation of at least one traveling pedal 12 is ascertained in Step 21, whether or not the foot switch 14 has been stepped on is determined. If the foot switch 14 is not depressed, the process returns to Step 21.

(Step 23)

If operation of at least one traveling pedal 12 is ascertained in Step 21, and operation of the foot switch 14 is ascertained in Step 22, the warning alarm 22 is activated.

(Step 24)

If neither traveling pedal 12 is ascertained in Step 21 to have been operated, whether or not an operating lever 13 has been operated is determined. If at least one operating lever 13 has been operated, the process returns to Step 22.

(Step 25)

If neither operating lever 13 is ascertained in Step 24 to have been operated, whether or not the operating levers 13 have been at the neutral position, at which the operating levers 13 are not being operated, for a predetermined period of time is determined. Until the predetermined period of time elapses, the process keeps returning to Step 21.

(Step 26)

If it is ascertained in Step 25 that the operating levers 13 have been at the neutral position for the predetermined period of time, whether or not the foot switch 14 has been stepped on is determined. If the foot switch 14 is not depressed, the process returns to Step 21.

(Step 27)

If operation of the foot switch 14 is ascertained in Step 26, the traveling alarm 21 is activated.

(Step 28)

Whether or not an operating lever 13 has been operated is determined.

(Step 29)

If neither operating lever 13 is ascertained in Step 28 to have been operated, whether or not the foot switch 14 has been stepped on is determined. If operation of the foot switch 14 is ascertained, the process returns to Step 27.

(Step 30)

If it is ascertained in Step 29 that the foot switch 14 is not depressed, a stop mode is initiated.

(Step 31)

When the stop mode is initiated, function of the hydraulic shovel is halted.

(Step 32)

Whether or not a traveling pedal 12 has been operated is determined.

(Step 33)

If neither traveling pedal 12 is ascertained in Step 32 to have been operated, whether or not an operating lever 13 has been operated is determined.

(Step 34)

If neither operating lever 13 is ascertained in Step 33 to have been operated, whether or not the foot switch 14 has been operated is determined.

(Step 35)

If any one of the following components, namely the traveling pedals 12, the operating levers 13, and the foot switch 14, has been operated, the warning alarm 22 is activated, and the process returns to Step 32.

(Step 36)

If it is ascertained in Step 34 that the foot switch 14 has not been stepped on, whether or not a predetermined period of time has elapsed is determined. Until the predetermined period of time elapses, the process keeps returning to Step 32. When the predetermined period of time has elapsed, the process returns to Step 21.

(Step 37)

If operation of at least one operating lever 13 is ascertained in Step 28, the joystick lever traveling mode is initiated, enabling the operating levers 13 to control the travel control valves 17 so as to operate the travel motors 2*m*.

(Step 38)

Whether or not the operating levers 13 have been at the neutral position, at which the operating levers 13 are not being operated, for a predetermined period of time is determined.

(Step 39)

If it is ascertained that the operating levers 13 have been at the neutral position for the predetermined period of time, the joystick lever traveling mode is deactivated, and the process returns to Step 21.

(Step 40)

If it is ascertained in Step 38 that the operating levers 13 have been at the neutral position, but the predetermined period of time has not yet elapsed, whether or not the foot switch 14 has been operated is determined. If the foot switch 14 is depressed, the process returns to Step 38. If the foot switch 14 is not depressed, the stop mode is initiated.

Next, functions and effects of the embodiment described above are explained.

While the foot switch 14 is not depressed, the operating levers 13 serve to perform normal actions, in other words, to operate the work device and/or perform swing action, and the traveling pedals 12, too, serve to operate the travel systems in a normal manner. To be more specific, a swing motor 3*m*, boom cylinders 6*c*, a stick cylinder 7*c*, and a bucket cylinder 8*c* are operated by the operating levers 13, and the right and left travel motors 2*m* are operated by means of the right and left traveling pedals 12.

The hydraulic shovel 1 is not provided with travel levers, which would otherwise be disposed in front of the operating seat of a conventional hydraulic shovel. Therefore, instead of the eliminated travel levers, the foot switch 14 provided at the feet of the operator is stepped on to cause the right and left operating levers 13, which normally serve to operate the work device and perform swing action, to function as travel control levers so as to respectively control operation of the right and left travel motors 2*m*.

To be more specific, moving the left operating lever 13 forward causes the left travel motor 2*m* to function for forward travel, and moving the left operating lever 13 rearward causes the left travel motor 2*m* to function for reverse travel. Moving the right operating lever 13 forward causes the right travel motor 2*m* to function for forward travel, and moving the right operating lever 13 rearward causes the right travel motor 2*m* to function for reverse travel.

As described above, while the foot switch 14 is depressed, the traveling pedals 12 are prevented from functioning so that travel operation can be performed only by the operating levers 13. When the foot switch 14 is stepped on, the traveling alarm 21 sounds an alarm. Should an operation error, such as stepping on both the foot switch 14 and a traveling pedal 12, occur, the warning alarm 22 sounds an alarm.

As described above, the foot switch 14, which serves to enable the common operating levers 13 to operate the traveling devices 2 and the work device 5, is disposed in the proximity of and operable with a foot of an operator seated at the operating seat 11. Therefore, switchover can easily be performed and it can also be easily recognized that switchover has taken place.

In other words, by operating the foot switch 14 with his foot, the operator is able to perform travel operation consciously with the operating levers 13. By simply removing the foot from the foot switch 14, the operator is able to return the machine to the normal operation mode without having to release his hands from the operating levers 13. Thus, the invention described above provides superior functionality that greatly simplifies switchover.

A particular merit of the embodiment is that, whenever the foot switch 14 is stepped on, the foot switch 14 activates the traveling alarm 21, making the operator fully aware that travel operation is being performed with the operating levers 13. Furthermore, the traveling alarm 21 is sounded prior to travel action taking place by the operating levers 13, allowing ample time to alert people in the vicinity.

Furthermore, should a traveling pedal 12 and the foot switch 14 be simultaneously stepped on, the warning alarm 22 is activated to prevent a mix-up that would otherwise be caused by simultaneous commands for travel operation from the traveling pedal 12 and an operating lever 13.

The foot-operated switchover means is not limited to the foot switch 14; for example, if a pedal similar to an attachment pedal for operating a breaker or a crusher or other attachment that is attached in place of the bucket 8 is provided at a side of a traveling pedal 12, such a pedal may serve as the foot-operated switchover means in place of the foot switch 14.

The present invention is applicable not only to a rotary-type work machine, such as the hydraulic shovel 1, but also to any work machine that has a traveling device 2 and a work device 5.

The invention claimed is:

1. A work machine having a traveling device and a work device, comprising:

an operating seat;

an operating lever disposed at a side of the operating seat and able to operate the traveling device and the work device;

a foot-operated switchover means disposed in the proximity of and operable with a foot of an operator seated at the operating seat; and a controller adapted to enable travel operation of the traveling device to be performed only by the operating lever while the foot-operated switchover means is depressed, and enable the work device to be operated by the operating lever while the foot-operated switchover means is not depressed.

2. The work machine in accordance with claim 1, further comprising:

a traveling alarm adapted to be activated when the foot-operated switchover means is depressed with the foot.

3. The work machine in accordance with claim 1, further comprising:

a traveling pedal adapted to be depressed with a foot of the operator seated at the operating seat; and a warning alarm adapted to be activated when the traveling pedal and the foot-operated switchover means are simultaneously depressed with the foot.

* * * * *